US005757291A

United States Patent [19]

Kull

[11] Patent Number: 5,757,291

[45] Date of Patent: May 26, 1998

[54] INTEGRATED PROXIMITY WARNING SYSTEM AND END OF TRAIN COMMUNICATION SYSTEM

[75] Inventor: Robert C. Kull, Olney, Md.

[73] Assignee: Pulse Electornics, Inc., Germantown, Md.

[21] Appl. No.: 524,985

[22] Filed: Sep. 8, 1995

[51] Int. Cl.[6] ..... G08G 1/123

[52] U.S. Cl. ..... 340/988; 246/122 R; 340/933; 340/961; 701/19; 701/301

[58] Field of Search ..... 340/961, 933, 340/988, 989, 991, 903; 364/424.024, 461; 246/122 R, 166.1, 25, 28 R; 701/19, 301

[56] References Cited

U.S. PATENT DOCUMENTS

| | | | |
|---|---|---|---|
| 2,762,913 | 9/1956 | Jepson . | |
| 3,281,779 | 10/1966 | Yeiser . | |
| 4,191,958 | 3/1980 | Hulland et al. . | |
| 4,358,763 | 11/1982 | Strauch | 455/19 |
| 4,549,309 | 10/1985 | Corrigan | 455/78 |
| 4,723,737 | 2/1988 | Mimoun . | |
| 4,735,383 | 4/1988 | Corrie | 246/122 R |
| 4,864,306 | 9/1989 | Wiita . | |
| 4,896,580 | 1/1990 | Rudnicki . | |
| 4,942,395 | 7/1990 | Ferrari et al. . | |
| 5,072,900 | 12/1991 | Malon . | |
| 5,129,605 | 7/1992 | Burns et al. . | |
| 5,153,836 | 10/1992 | Fraughton et al. | 340/961 |
| 5,239,686 | 8/1993 | Downey | 455/78 |
| 5,332,180 | 7/1994 | Peterson et al. . | |
| 5,366,183 | 11/1994 | Gill . | |
| 5,374,015 | 12/1994 | Bezos et al. | 246/169 R |
| 5,507,457 | 4/1996 | Kull | 364/424.024 |
| 5,574,469 | 11/1996 | Hsu | 364/461 |

*Primary Examiner*—Brent A. Swarthout
*Attorney, Agent, or Firm*—Whitham, Curtis & Whitham

[57] ABSTRACT

Proximity warning system (PWS) functions are integrated into the locomotive control unit (LCU) of an end of train (EOT) communication system. The PWS operation provides increased information to train crews relating to the location and movement of other trains in the area. The PWS functions are supported with the addition of a separate high speed modem which can access the LCU transmitter. A second radio receiver, the same frequency as the existing LCU transmitter, allows reception of transmissions from other PWS equipped locomotives. A location determination device, such as a GPS receiver, establishes current location and direction. The PWS operation is controlled by a microcontroller which, together with the existing LCU microcontroller, manages the control of the integrated system operation.

14 Claims, 6 Drawing Sheets

INTEGRATED PROXIMITY WARNING SYSTEM AND END OF TRAIN COMMUNICATION SYSTEM

BACKGROUND OF THE INVENTION

1. Field of the Invention

The present invention generally relates to railroad anticollision systems and, more particularly, to a proximity warning system (PWS) which may be integrated into the locomotive control unit (LCU) of a standard end of train (EOT) communication system.

2. Background Description

North American railroads have established a standard means of two-way communications between locomotives and end of train (EOT) devices. The association of American Railroads (AAR) has established standard radio frequencies (with FCC permission) and protocols to allow interchange of locomotive equipment and EOT units between railroads and equipment suppliers. A locomotive control unit (LCU) is used for communications with EOT devices, which consists of the following main components:

Transmitter—AAR standard frequency is 452.9375 MHZ

Receiver—AAR standard frequency is 457.9375 MHZ

Data modem—AAR standard is FFSK modulation, operating at 1200 bits per sec.

Microcontroller—RF message to AAR standards, and logic

Power supply—powers unit from the locomotive battery

Operator interface—displays and input buttons/switches

The LCU is normally integrated into a single unit and mounted in the engineer control stand area. Other versions are provided with the operator interface separated from other functions.

Normal EOT system operation is based upon status message initiation from the EOT device, with reception by the LCU. This is typically initiated upon brake pipe pressure changes or start/end of motion. Even with no status changes, EOT transmissions are initiated at approximately one minute intervals for communications and train integrity verification purposes. Likewise, the LCU can initiate selected messages to the EOT device. The primary function of the LCU to EOT messaging is to allow initiation of an emergency brake application from the rear of the train in the event of inability to control the brakes by conventional means from the locomotive. Although this capability is very rarely used, it is important that it is known to be available for use on a regular basis. Therefore, communications check messages are typically sent at approximately ten minute intervals from the LCU to the EOT unit, and a confirmation message is sent back to the LCU from the EOT unit.

Procedures have been established to use unique identifications (IDs) in each EOT unit to allow multiple trains to operate within the same RF coverage area, with each locomotive communicating with only its designated EOT unit. The system allows for some amount of message collision between systems, due to the number of repeated transmissions which are typically made during times of EOT status changes. In practice, the messaging lengths and rates have been sufficiently small such that message collisions between different trains has not presented a serious operational problem. The net result of current practice is that the radio frequency used for LCU to EOT transmissions is utilized at a very low level, since use of emergency brake applications are extremely rare, and communications checks are made at ten minute intervals.

It is desirable to provide a railway anticollision feature to warn engineers of the proximity, direction of travel and speed of other trains in his vicinity. Such systems are generally known in the art. For example, U.S. Pat. No. 2,762,913 to Jepson shows a railway train proximity warning system employing a transmitter, a receiver and a modulator. The transmitter radiates an identifiable signal ahead of and behind the train which can be received by nearby trains similarly equipped. U.S. Pat. No. 4,864,360 to Wiita shows a railway anticollision system in which train location information is determined from readable trackside markers and is transmitted between trains and to a central station. Directional antennas are used in the front and rear of the trains. U.S. Pat. No. 4,896,580 to Rudnicki shows a railroad system comprising a transceiver, an antenna and a global positioning (GPS) receiver. Location information is transmitted to a central location which computes closure times and then transmits this information to other trains on the system.

Such railroad anticollision systems add to the complexity of the installed equipment onboard the locomotive and often require the cooperation of a central station. It is desirable to provide a self-contained anticollision system having a simplified installation and user interface to facilitate widespread application and use of the system on railroads.

SUMMARY OF THE INVENTION

It is therefore an object of the present invention to provide an enhancement of the LCU to allow direct train to train communications for proximity warning with no material impact on the standard LCU to EOT functions.

It is another object of the invention to use the current LCU transmitter and channel to serve expanded functions associated with communications between lead locomotives on trains within the same RF coverage area.

According to the invention, a proximity warning system (PWS) is added to a locomotive cab unit (LCU) in an end of train (EOT) communication system. LCUs are primarily used for two-way communication with a dedicated EOT unit. The invention adds an additional receiver and PWS central processing unit (CPU), a high speed modem, and a global positioning system (GPS) receiver to the existing LCU in order to initiate train-to-train communication for giving trains in the same radio frequency (RF) region proximity information for collision avoidance. Such proximity information may include train location (e.g., latitude and longitude or some other location reference), speed, train identification (ID), and direction of nearby trains. The existing transmitter for the LCU is used to perform transmissions to both the EOT unit and to other LCUs. The CPUs monitor both of the receivers and control the transmitter to ensure that transmissions are not made when data is being received on either RF channel. Should a data collision occur, the proximity data will be completed in the initial synchronization period so that sufficient time will remain for the standard LCU to EOT message to be received.

The PWS may be fabricated either within the same LCU package or in a separate package interfaced to a modified LCU, depending on the specific application. A further modification is the addition of a separate PWS to the EOT device. This modification provides information as to the location of the end of the train as well as the location of the lead locomotive.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
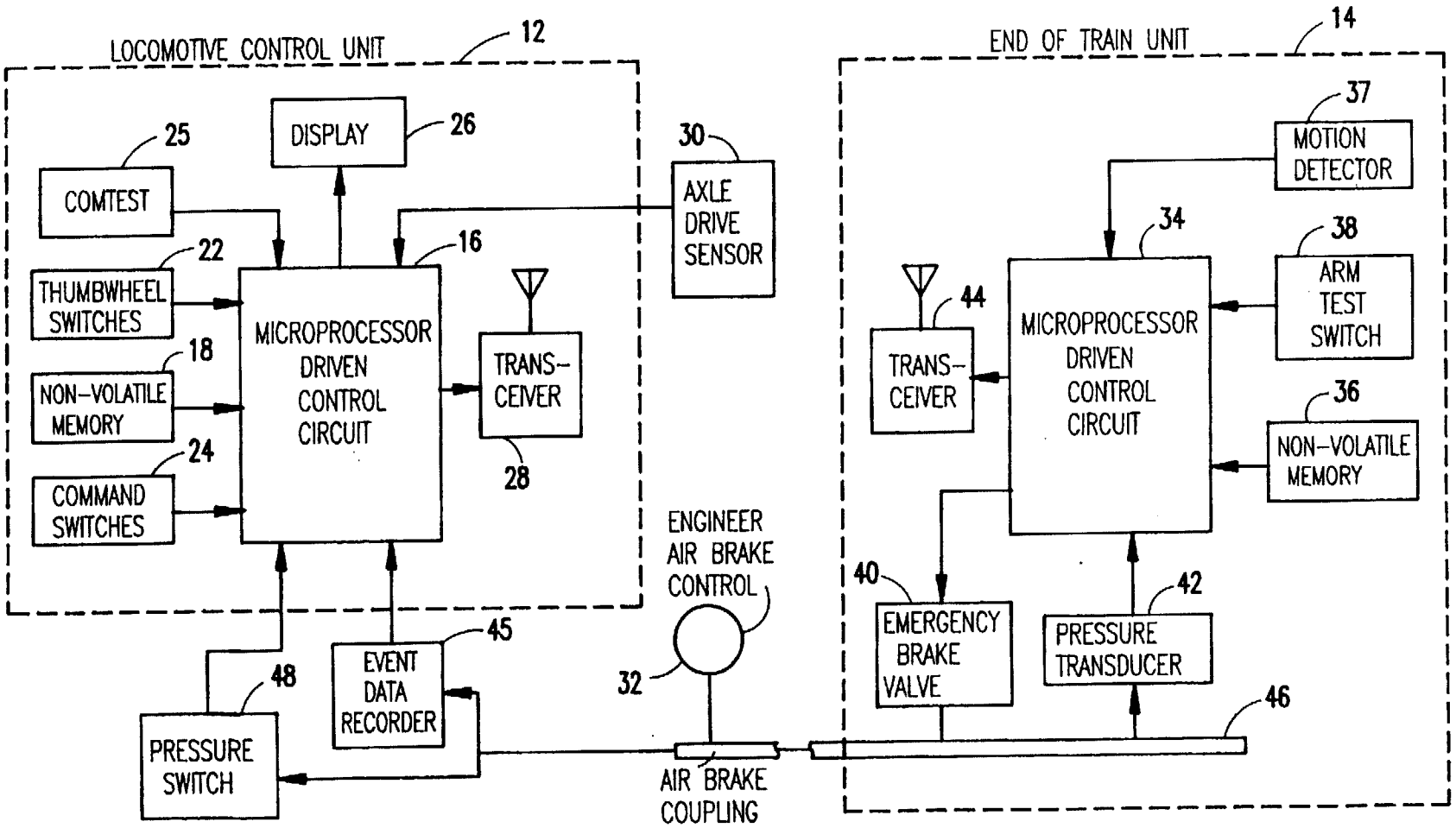
FIG. 1 PRIOR ART
FIG. 1 is a block diagram showing the major component parts of the EOT and the LCU.

Referring now to the drawings, and more particularly to FIG. 1, there is shown a block diagram of a conventional end of train (EOT) communication system comprising a locomotive control unit (LCU) 12 and an end of train (EOT) unit 14 mechanically linked together by a train (not shown) and communicating by radio broadcast. The EOT unit 14 is typically mounted on the trailing coupler (not shown) of the last car in the train and is equipped with pressure monitoring and telemetry circuitry. A hose is connected between the train's brake pipe and the EOT unit so that the air pressure of the brake pipe at the end of the train can be monitored.

The LCU 12 includes microprocessor control circuit 16, a nonvolatile memory 18 which stores the control program for the microprocessor control circuit, and a series of thumb wheel switches 22 through which an operator stationed at the LCU can manually enter the unique code number of the EOT unit 14. In addition to inputs from the thumb wheel switches and nonvolatile memory, the microprocessor control circuit 16 also has a command switch input 24 and a communication test (COMTEST) switch input 25 and provides outputs to a display 26 and transceiver 28. A locomotive engineer controls air brakes via the normal locomotive air brake controls, indicated schematically at 32, and the normal air brake pipe 46 which extends the length of the train. Existing LCUs are connected to the locomotive's axle drive via an axle drive sensor 30 which provides typically twenty pulses per wheel revolution.

The EOT unit 14 includes a microprocessor control circuit 34, and a nonvolatile memory 36 in which the control program for the microprocessor controller and a unique identifier code of the particular EOT unit 14 are stored. The microprocessor control circuit 34 also has inputs from a manually activated arming and test switch 38 and a brake pressure responsive transducer 42 and an output to an emergency brake control unit 40 coupled to the brake pipe 46. The EOT unit 14 communicates with radio transceiver 28 of the LCU 12 by way of a radio transceiver 44.

In addition, at the front of the train (e.g., the locomotive) there is typically an event data recorder 45 which is coupled to the brake pipe 46 at the locomotive. An output of data recorder 45 is coupled to the LCU microprocessor control circuit 16 so that changes in brake pressure at the locomotive end of the brake pipe are coupled to the microprocessor control circuit 16. A pressure switch 48 is also connected to the brake pipe 46 and provides an output directly to the microprocessor control circuit 16. The function of the pressure switch 48, which has a typical threshold on the order of 25 psi, is to sense and communicate to the LCU 12 the arrival of an emergency brake application.

The present invention relates to the addition of a proximity warning system (PWS) to the LCU 12 as currently used in EOT communications. The PWS may be fabricated either within the same package as the LCU or in a separate package interfaced to a modified LCU. The choice is a matter of specific application. PWS operation is based upon each locomotive sending regular radio transmissions (normally five to fifteen seconds apart), which include the following information:

- Location—This may be by using a global positioning system (GPS) receiver, in terms of latitude and longitude readings, or by specific references (such as milepost location), as received from another locomotive system.
- Speed—As received from GPS or locomotive axle generators/ speedometers.
- Locomotive or Train ID number—This would normally include a railroad company ID, followed by the "Road Number" of the lead locomotive.
- Direction—This could be a GPS heading (in degrees) or an up/down direction relating to a specific railroad track.
- Optional data—Other data could include the EOT device ID.

Trains in the RF range of other locomotives providing PWS transmissions would receive messages and perform computations to allow display to the engineer of the following information:

- Distance—If GPS based, the "straight line" distance from the receiving train's current location and the transmitting train's message would be computed and displayed in a common units measure, such as miles. If track ID based, the track distance could be computed and only displayed if it is on an interconnecting route.
- Speed—The speed of the other locomotive can be displayed, typically in MPH.
- Locomotive ID—The ID of the other locomotive can be displayed, typically railroad initials and road number.
- Direction—If GPS based, the relative direction between the transmitting and receiving trains is computed. This can be displayed on a 360 degree scale, or a 1–12 o'clock scale.
- Message age—The time expired since the last update message from the same locomotive ID can be displayed. In this manner, the engineer can determine how current the displayed status information is and receive and indication of subsequent loss of communications.

The overall PWS operation provides increased information to train crews relating to the location and movement of other trains in the area. This information is to enhance safety and operating efficiencies.

The invention provides a means to integrate the PWS and LCU functions into a single unit with sharing of the locomotive transmitter as currently used for messaging to EOT units. It also provides a means of adding PWS operations with virtually no degradation of standard EOT functions. Key elements of the invention are shown in FIG. 2, to which reference is now made.

Figure 2:
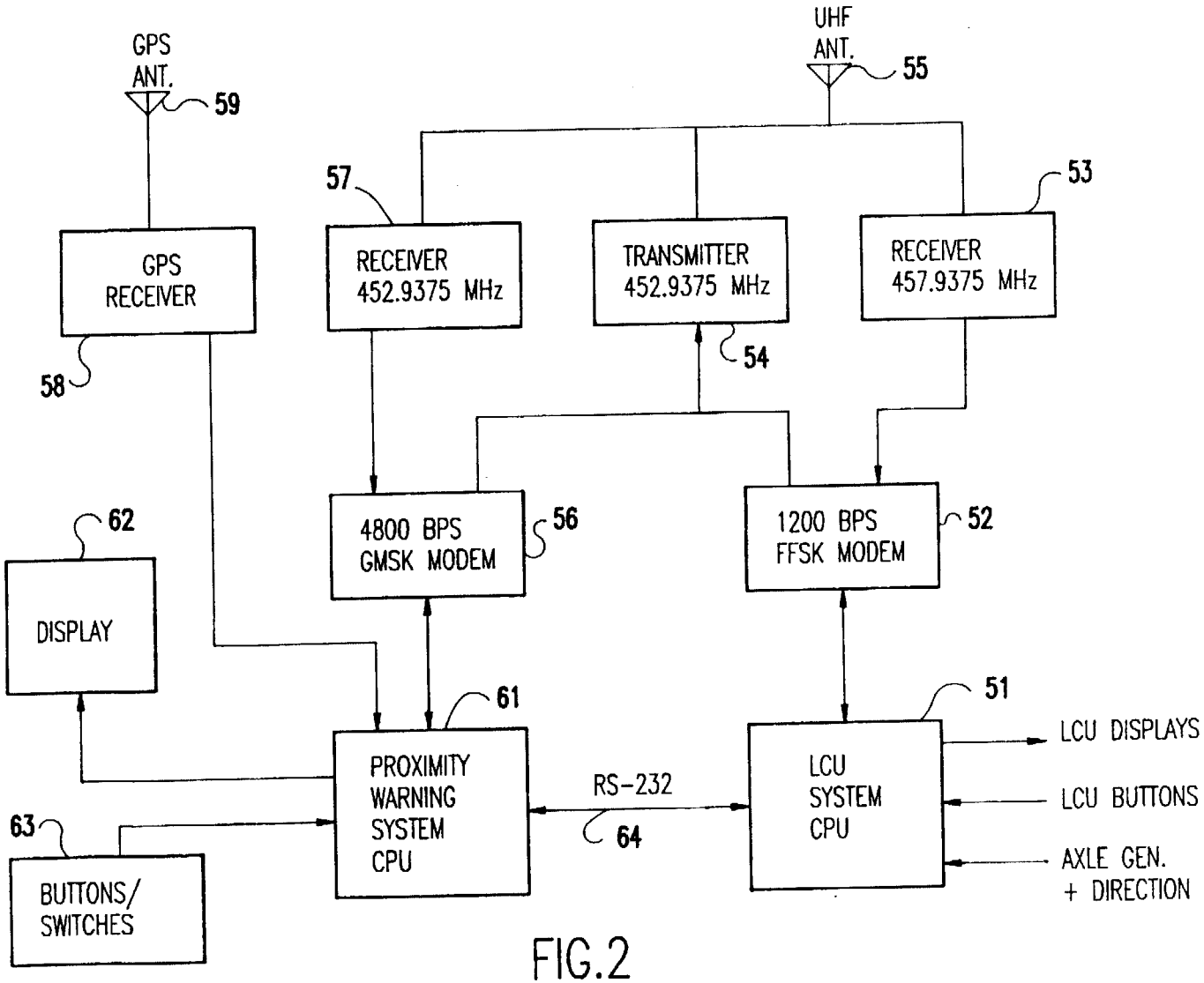
FIG. 2 is a block diagram showing the proximity warning system of the present invention integrated into the LCU according to a preferred embodiment of the invention using global positioning system (GPS) location determination.

The LCU microprocessor driven control circuit 16 of FIG. 1 includes an LCU system central processing unit (CPU) 51 having the several inputs and outputs shown in FIG. 1, only a few of which are represented in FIG. 2 for the sake of simplicity. The LCU transceiver 28 is composed of a 1200 BPS FFSK modem 52, a 457.9375 MHZ receiver 53 and a 452.9375 transmitter 54. The receiver 53 and transmitter 54 are connected to a UHF antenna 55. A separate, higher speed (nominally 4800 BPS) GMSK data modem 56 and a second radio receiver 57, having the same frequency of the existing LCU transmitter (i.e., 452.9375 MHZ), are added. The modem 56 is connected to both the existing transmitter 54 and the added receiver 57, and the receiver 57 is connected to the UHF antenna 55. The receiver 57 allows reception of transmissions from other PWS equipped locomotives.

Figure 3:
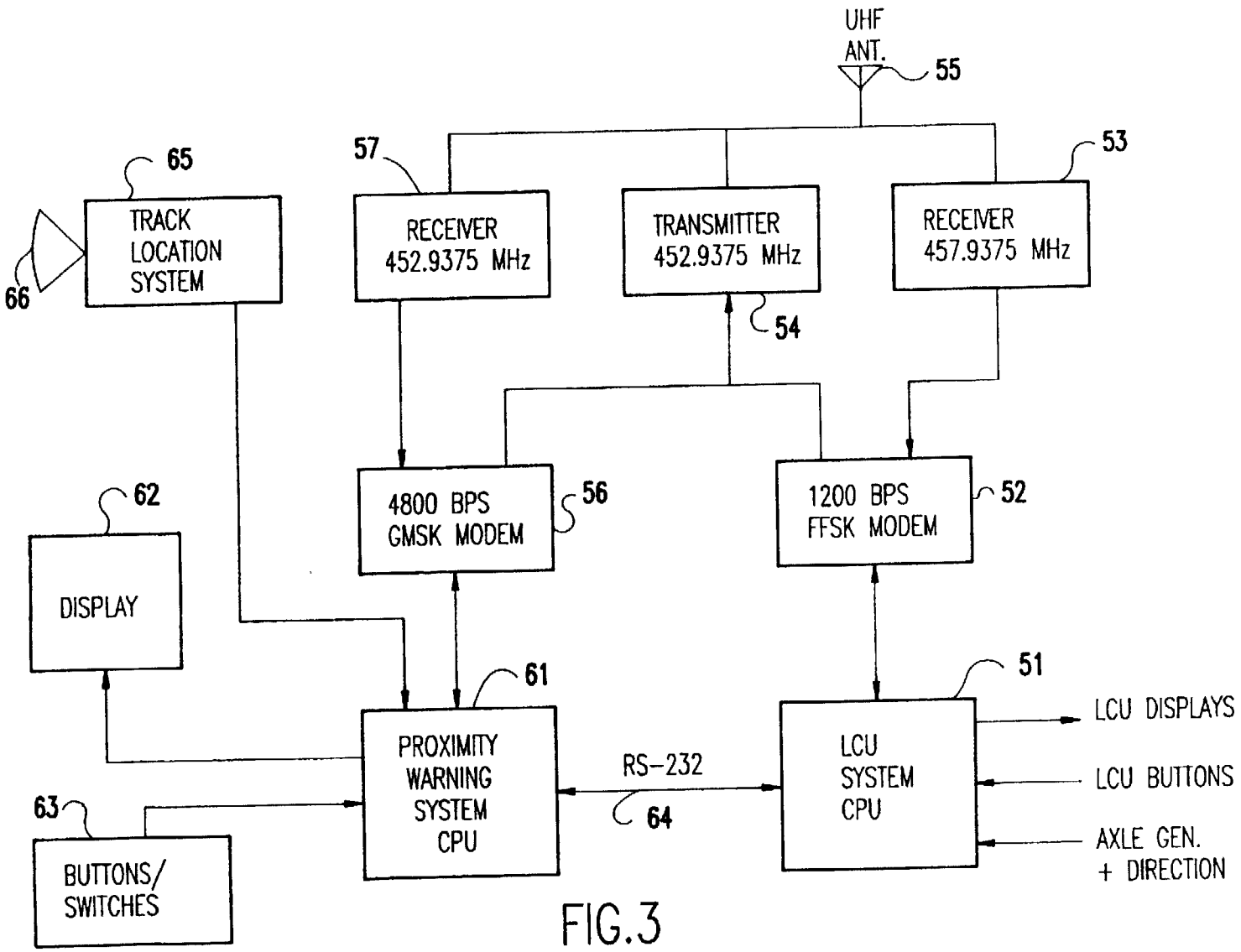
FIG. 3 is a block diagram showing the proximity warning system of the present invention integrated into the LCU according to a preferred embodiment of the invention using an alternative railroad milepost location determination.

A location determining device is also added to the LCU. In the embodiment shown in FIG. 2, this device is a global positioning system (GPS) receiver 58 connected to a separate GPS antenna 59. While this is the preferred embodiment, other location determining devices may be used in the practice of the invention. In FIG. 3, the location determining device is a track location system 65, of known type, which uses a transducer 66 to detect and read mileposts along the track. The transducer 66 may be on optical transducer (e.g., infrared), microwave or other RF, inductive, or acoustic (e.g., ultrasound). Using a track location system of this type, other information, such as speed and direction, normally provided by the GPS receiver must be locally generated. This information is already available to most LCUs from, for example, a speedometer. By integrating speed between mileposts, a precise location can be computed.

Referring to both FIGS. 2 and 3, the location determining device establishes current location and direction. A proximity warning system (PWS) operation microcontroller, comprising a PWS CPU 61, receives the location information from the GPS receiver 58 or the track location system 65 and data from modem 56 derived from transmissions received from other PWS equipped locomotives and computes the data described above. In addition, the PWS CPU 61 generates messages which are supplied to modem 56 for transmission by LCU transmitter 54 to other PWS equipped locomotives. The PWS CPU 61 provides output information to a PWS display 62 and receives inputs from the engineer via PWS buttons/switches 63. Preferably, the PWS display 62 is integrated into the LCU display 26.

The PWS data radio message protocol is constructed in the following manner:

| Bits | Purpose | Notes |
|---|---|---|
| 96 | Synchronization | Pattern "00110011 . . ." for synchronization |
| 11 | Frame Sync | Allows receiver to mark start of data message |
| 05 | Message Type | Allows for defining new messages types |
| 16 | Locomotive ID | Usually 4 digit road number in binary |
| 04 | Direction | Train movement direction from GPS |
| 10 | Railroad ID | Two alpha characters for RR ID |
| 17 | EOT ID | The ID of the assigned EOT unit |
| 32 | Lat/Long | Latitude/longitude GPS data |
| 08 | Speed | Current locomotive speed |
| 01 | Spare | Future optional data |
| 16 | CRC-16 | Error check on entire message |
| 08 | End of Frame | Marks end of message |

The above results in an entire message length of 224 bits, which has a message transmission time of 0.04667 seconds (under 50 ms.)

An important feature of the protocol in the PWS application is its compatibility with the AAR standard LCU to EOT data protocol. The AAR standard provides 380 ms of initial synchronization time, of which at most 25% is needed by the EOT radio receiver. The PWS system logic will normally prevent initiation of a PWS or LCU to EOT transmission when another locomotive within RF range is transmitting. However, it is possible for more than one locomotive to initiate transmissions at close to the same times. In the rare event of this happening, the PWS message would start close to the same time as another LCU to EOT transmission. However, due to the under 50 ms message length of the PWS transmission, it would be completed well within the LCU to EOT message synchronization time, and ample time would remain to allow the EOT message to be successfully received.

With a message length of 50 ms and a nominal PWS message repeat rate of six times per minute, each locomotive would utilize the radio channel approximately 0.5% of the time. This adds to the current LCU to EOT message length of 560 ms, with repeats each ten minutes, having an average channel utilization of approximately 0.09%. Therefore, the total of EOT and PWS messaging represents an average channel utilization of approximately 0.6%. With an expected maximum of thirty "on the road" trains within an expected RF coverage area, the total channel utilization would be approximately 18%. With the carrier detection prior to transmit logic, there would be very few message collisions and few cases where message transmission would need to be delayed beyond several seconds.

With wide application of PWS, where channel capacity reaches 20%, each unit will detect the high channel use rate and can be programmed to dynamically change message repetition rates. The nominal message repetition rate may be set at ten seconds, with a change to fifteen seconds in high capacity areas. This will provide approximately 50% increase in capacity for the same channel loading. Likewise, where light channel use is detected, the repetition rate can be increased to provide faster system response in remote light traffic areas.

The inclusion of EOT ID with the PWS transmission allows for receiving locomotives to also listen to standard EOT message transmissions from other trains and associate them with train ID. It also allows a receiving locomotive to identify EOT transmissions which have not yet been matched to a PWS equipped locomotive. This provides the means for providing a level of information from reception of standard EOT transmissions, where the corresponding locomotive may be out of RF range or not equipped with EOT capability.

Key to the practice of the invention is the use of an RF messaging scheme, coupled with added carrier sense multiple access (CSMA) logic, which allows the addition of PWS functions without a significant effect to EOT operations. This is achieved by the use of separate EOT and PWS receivers and modems which allow locomotive reception of both messages at the same time, through a common antenna. The single transmitter 54 can be accessed by both the PWS and EOT modems and microcontrollers, with access controlled by software in both microcontrollers, and coordination of the two based upon the serial data interface 64 between the two CPUs. This allows all EOT message transmissions to be given priority over PWS messages. The logic and associated circuitry allows the microcontrollers to monitor both receivers for radio receptions prior to initiating transmissions. This substantially reduces the chances for message collisions between different locomotives in the same RF coverage area. PWS message lengths are kept very low, due to the higher speed modem, an efficient encoding scheme, and fast response radios. This reduces channel congestion for a given number of PWS operable trains in the same RF coverage area. In the rare event of near simultaneous initiation of radio messages from two or more locomotives, such that monitoring is not effective, the PWS message will be completed within the initial synchronization portion of the LCU to EOT messages. This leaves sufficient time for the standard AAR LCU to EOT message to still be received.

To improve or extend locomotive to locomotive communications coverage in areas where direct communications coverage is unreliable (e.g., mountainous areas, etc.), repeater units can be provided at fixed locations. A repeater is essentially the same as the LCU PWS subsystem shown, for example, in FIG. 2 except that it does not require the EOT receiver 53, the GPS receiver 58, the 1200 BPS modem 52, LCU system CPU 51, and various displays and inputs. Thus, a repeater unit basically comprise the PWS CPU 61, the 4800 BPS modem 56, the transceiver comprising transmitter 54 and receiver 57, and the UHF antenna 55. The basic operation of the repeater is to listen for PWS messages, decode them, delay (nominally one to two seconds) and re-transmit the messages. The same CSMA logic is employed as on the LCU PWS units to manage channel contention.

Figure 4:
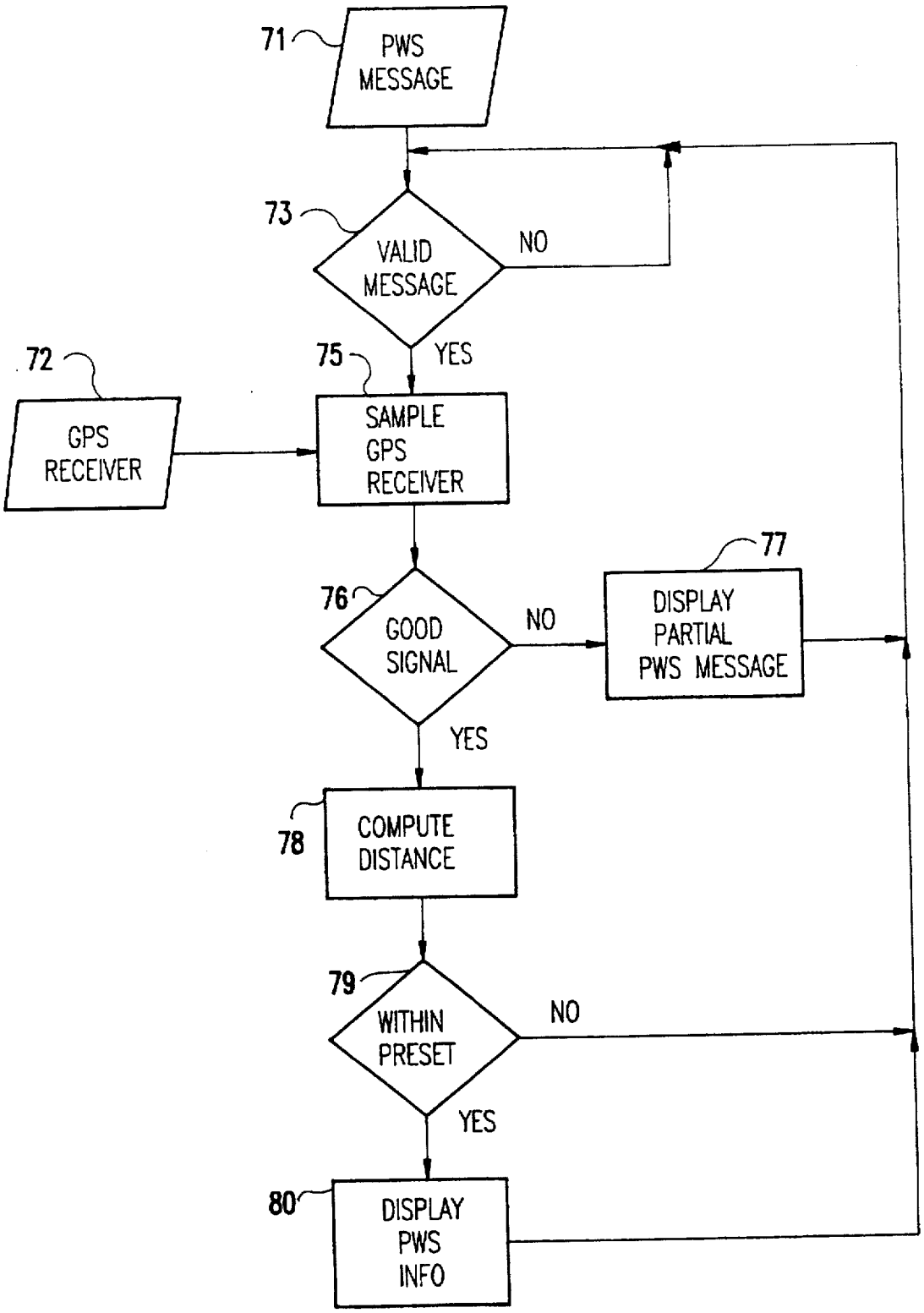
FIG. 4 is a flow diagram showing the logic of the control program for the proximity warning system (PWS) central processing unit (CPU) in the receive mode.

FIG. 4 is a flow diagram illustrating the operation of the control program for the PWS CPU 61 in the receive mode. There are two inputs in this mode. These are the RF message received from the 4800 BPS modem 56, indicated by input 71, and location and other information from the GPS receiver 58, indicated by input 72. When an RF message is received, an error check is made of the message in decision block 73 to determine if a valid message has been received. If not, the process returns to an idle mode awaiting the reception of another message. If the error check indicates that a valid message has been received, the input from the GPS receiver 58 is sampled at function block 75 and a test is made at decision block 76 to determined if the GPS signal is "good". If the GPS signal is not "good" or not readable, a partial PWS message is displayed at function block 77. This partial message typically would display only that a PWS message has been received and the locomotive's ID and speed. Distance cannot be computed without good GPS data from both locomotives. The process then returns to an idle mode. When there is both a valid message and a "good" GPS signal, a comparison is made of the received latitude/longitude data and the LCU's own latitude/longitude data from which the distance to the other locomotive and its relative direction are computed in function block 78. A comparison is then made in decision block 79 to determine if the computed distance is greater than a preset distance. If so, no display is generated and the process returns to a idle state. However, if the computed distance is within the preset distance, the locomotive ID, speed, distance (typically three to eight miles) and direction are displayed at function block 80. This message is displayed with a time stamp to show an age of the message.

Figure 5:
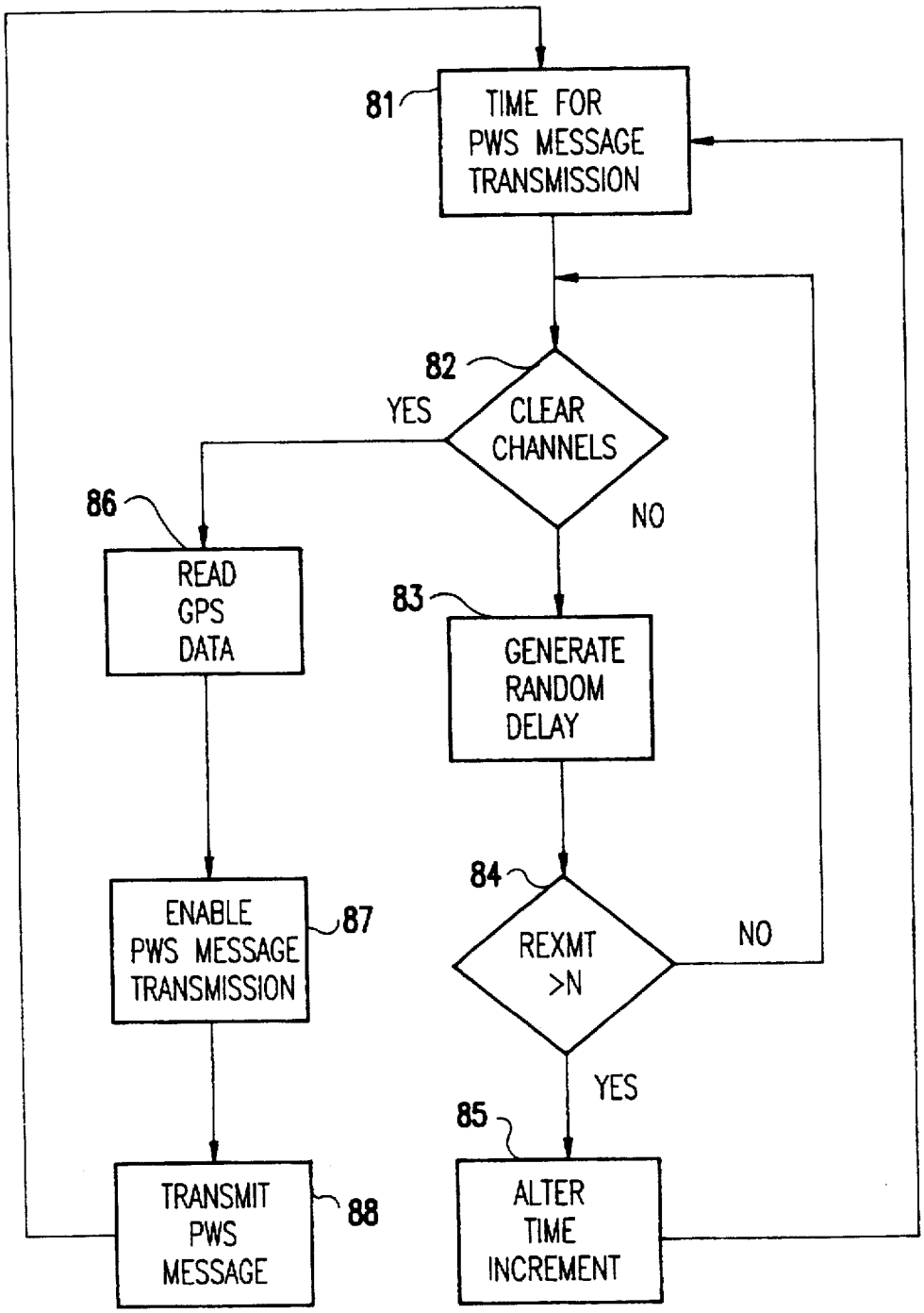
FIG. 5 is a flow diagram showing the logic of the control program for the PWS CPU in the transmit mode.

FIG. 5 is a flow diagram illustrating the operation of the control program for the PWS CPU 61 in the transmit mode. Periodically, the LCU transmits PWS messages; however, the actual timing of the PWS messages is adjusted depending on sensed conditions. The process begins in function block 81 by a software clock in the CPU 61 initiating a fixed starting time between transmission tries. A check is made in decision block 82 to determine if both EOT receiver 53 and PWS receiver 57 have clear channels; that is, no messages are being received by either receiver. If not, a random time delay is generated in function block 83, and then a test is made in decision block 84 to determine the number of transmission retries that have been made. If the number of retries is below a predetermined number, the process returns to decision block 82 to check the EOT and PWS channels for a transmission retry. If the number of retries exceeds the predetermined number, the time increment between transmitting PWS messages is altered in function block 85. When both the EOT and PWS channels are clear, the latest GPS data is read in function block 86, and then the transmission of the PWS message is enabled in function block 87. The PWS message is sent to the 4800 BPS modem 56 in function block 88 which keys the PWS transmitter 54 to broadcast the PWS message. However, should there be an emergency EOT transmission received by 53 and modem 52, the LCU CPU 51 working with PWS CPU 61 will interrupt any PWS message in progress. This is a priority interrupt since the emergency EOT message has a higher priority than the PWS function.

Figure 6:
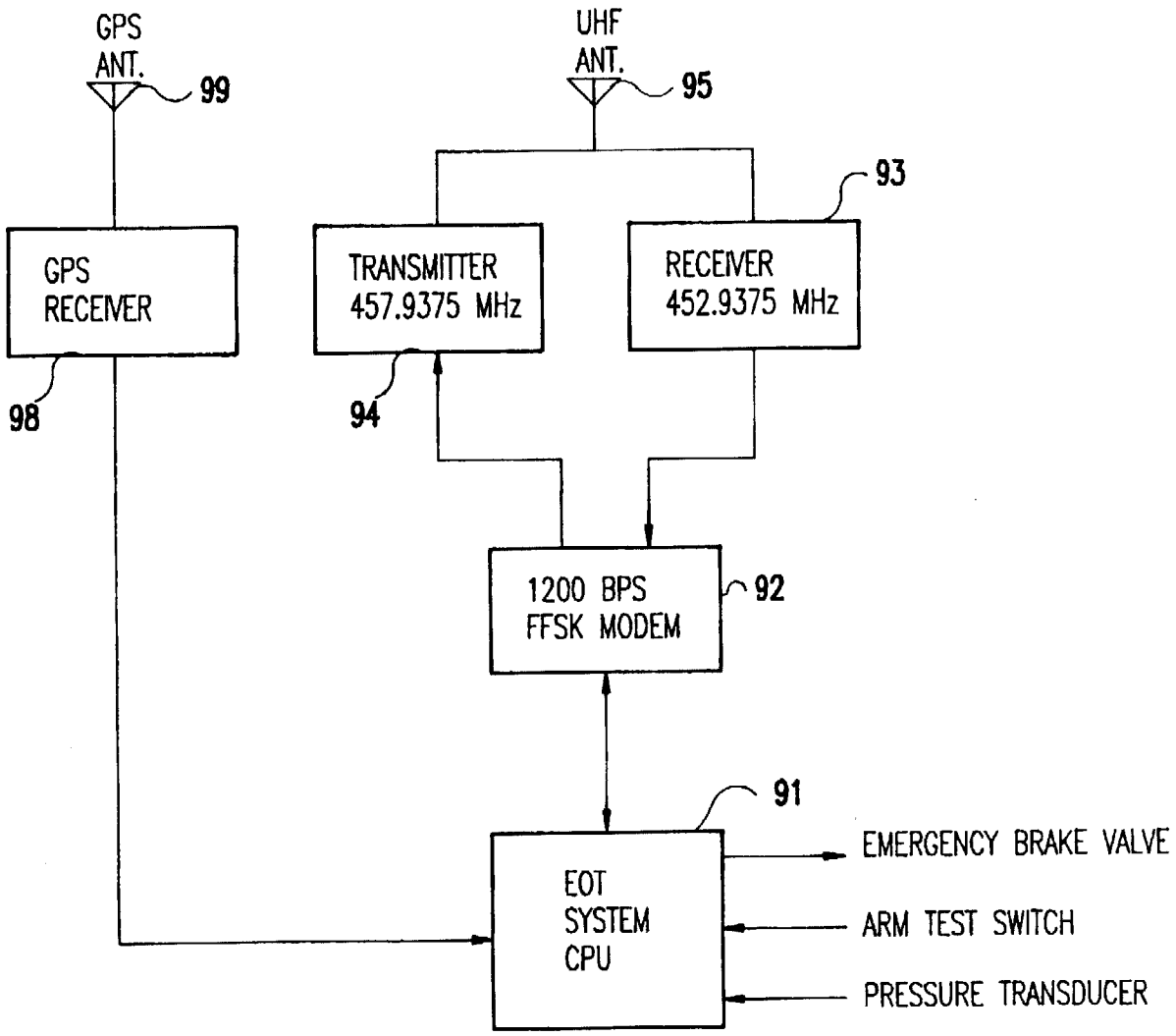
FIG. 6 is a block diagram showing an end of train (EOT) unit having a GPS receiver used for location determination of the end of the train.

The system design also allows provision for optional addition of location information capability in EOT units, such as from an additional GPS receiver. This arrangement is shown in FIG. 6. The EOT microprocessor driven control circuit 34 of FIG. 1 includes an EOT system central processing unit (CPU) 91, and the EOT transceiver 44 is composed of a 1200 BPS FFSK modem 92, a 452.9375 MHZ receiver 93 and a 457.9375 transmitter 94. The receiver 93 and transmitter 94 are connected to a UHF antenna 95. A GPS receiver 98 is connected to a separate GPS antenna 99 and provides an input to the EOT CPU 91. The EOT CPU 91 adds GPS data to the normal EOT transmit channel (457.9375 MHz) using the 1200 BPS modem 92.

By providing the additional GPS receiver 98, locomotive LCUs equipped with PWS units can directly interrogate EOT units from other trains to receive location information. This is particularly of value in "following moves" operations, where a locomotive following another train is primarily concerned with the end of train location. An added feature of providing a GPS receiver in the EOT unit is to allow its train's locomotive to compute train length by comparing EOT to LCU GPS data. Additionally, this added feature can provide enhanced train integrity information by confirming EOT movement direction and speed as consistent with the locomotive.

While the invention has been described in terms of a single preferred embodiment with modifications, those skilled in the art will recognize that the invention can be practiced with modification within the spirit and scope of the appended claims.

Having thus described my invention, what I claim as new and desire to secure by Letters Patent is as follows:

1. A proximity warning system (PWS) unit for providing a warning of trains traveling in a common radio frequency region, the proximity warning system unit cooperating with a locomotive cab unit (LCU) which communicates with an end of train (EOT) unit and comprising:

location means for determining current location data;

a PWS receiver for receiving location data from other trains;

an EOT receiver for receiving data from the end of train unit;

control means for monitoring said PWS receiver and said EOT receiver, said control means using said current location data and location data from other trains to calculate proximity to the other trains;

display means controlled by the control means for displaying the calculated proximity to the other trains; and a transmitter controlled by said control means to transmit said current location data and identification data in a PWS message to other trains, said control means including carrier sense multiple access logic for permitting simultaneous reception from both said PWS receiver and said EOT receiver and for permitting transmission of the PWS message only when said PWS receiver and said EOT receiver are idle.

2. The proximity warning system unit recited in claim 1 wherein said location means comprises a global position system (GPS) receiver which provides current location data in latitude and longitude and speed and direction data of the locomotive, said PWS message further including the speed and direction data.

3. The proximity warning system unit recited in claim 1 wherein said location means comprises a track location system providing milepost data to said control means, further comprising speed and direction sensing means providing inputs to said control means, said control means computing a current location a function of said milepost data and speed, said PWS message further including speed and direction data.

4. The proximity warning system unit recited in claim 1 wherein said control means includes a PWS central processing unit (CPU), said LCU having a separate LCU CPU, the LCU CPU controlling communications with the EOT unit and communicating with the PWS CPU to suppress a PWS message transmission in the event of the reception of a EOT unit message.

5. The proximity warning system unit recited in claim 4 wherein the EOT unit is equipped with a receiver for two-way communication between the LCU and the EOT unit, said LCU CPU further acting to suppress a PWS message by the PWS CPU in the event of a transmission by the LCU to the EOT unit.

6. A proximity warning system (PWS) unit for providing a warning of trains traveling in a common radio frequency region, the proximity warning system unit cooperating with a locomotive cab unit (LCU) which communicates with an end of train (EOT) unit and comprising:

location means for determining current location data;

a PWS receiver for receiving location data from other trains;

an EOT receiver for receiving data from the end of train unit;

control means for monitoring said PWS receiver and said EOT receiver, said control means using said current location data and location data from other trains to calculate proximity to the other trains;

display means controlled by the control means for displaying the calculated proximity to the other trains;

a transmitter controlled by said control means to transmit said current location data and identification data in a PWS message to other trains, said control means including carrier sense multiple access logic to control transmission of the PWS message only when said PWS receiver and said EOT receiver are idle; and a second location means in the EOT unit, said EOT unit transmitting to the LCU a current location of an end of the train.

7. The proximity warning system unit recited in claim 6 wherein the PWS message includes an EOT identification (ID) and the EOT unit includes a receiver for responding to interrogations from other locomotive LCUs to transmit the current location of the end of the train.

8. A method of providing proximity warning information to an engineer of a train having an end of train (EOT) communication system installed in which an EOT unit transmits EOT pressure information to a locomotive cab unit (LCU), said method comprising the steps of:

receiving a proximity warning system (PWS) message transmitted by another train;

receiving current location information;

calculating proximity from the other train based on the received PWS message and the current location information;

displaying the calculated proximity from the other train;

simultaneously receiving and monitoring the reception of PWS messages and messages received from the EOT unit; and only when no PWS messages or messages from the EOT unit are being received, transmitting a PWS message including current location data and identification data.

9. A proximity warning system (PWS) for warning trains traveling in a common radio frequency region of the proximity of other trains, said PWS comprising a PWS unit mounted on each of cooperating locomotives in the common radio frequency region, the PWS unit having an integrated function with a locomotive cab unit (LCU) which communicates with an end of train (EOT) unit and comprising:

location means for determining current location data;

a PWS receiver for receiving PWS messages from other trains, a PWS message including locomotive identification (ID), location data, direction data, speed data, and railroad ID;

an EOT receiver for receiving data from the end of train unit;

control means for monitoring said PWS receiver and said EOT receiver, said control means using said current location data and location data from other trains to calculate proximity to the other trains;

display means controlled by the control means for displaying the calculated proximity to the other trains, locomotive ID, direction data, speed data, and railroad ID for each of said other trains; and a transmitter controlled by said control means for transmitting said current location data, direction data, speed data, and identification data in a PWS message to other trains, said control means including carrier sense multiple access logic for permitting simultaneous reception from both said PWS receiver and said EOT receiver and for permitting the transmission of said PWS message only when said PWS receiver and said EOT receiver are idle.

10. The proximity warning system recited in claim 9 further comprising a repeater PWS unit mounted at a fixed location within the common radio frequency region to improve or extend a direct locomotive to locomotive communications coverage, said repeater PWS unit comprising:

a second PWS receiver for receiving PWS messages;

a second transmitter for transmitting PWS messages; and a second control means connected to said second PWS receiver and second transmitter for decoding received PWS messages, delaying the decoded PWS messages, and then retransmitting the PWS messages on said second transmitter, said second control means including carrier sense multiple access logic to retransmit the PWS messages only when the second PWS receiver is idle.

11. The proximity warning system unit recited in claim 6 wherein said location means comprises a global position system (GPS) receiver which provides current location data in latitude and longitude and speed and direction data of the locomotive, said PWS message further including the speed and direction data.

12. The proximity warning system unit recited in claim 6 wherein said location means comprises a track location system providing milepost data to said control means, further comprising speed and direction sensing means providing inputs to said control means, said control means computing a current location a function of said milepost data and speed, said PWS message further including speed and direction data.

13. The proximity warning system unit recited in claim 6 wherein said control means includes a PWS central processing unit (CPU), said LCU having a separate LCU CPU, the LCU CPU controlling communications with the EOT unit and communicating with the PWS CPU to suppress a PWS message transmission in the event of the reception of a EOT unit message.

14. The proximity warning system unit recited in claim 13 wherein the EOT unit is equipped with a receiver for two-way communication between the LCU and the EOT unit, said LCU CPU further acting to suppress a PWS message by the PWS CPU in the event of a transmission by the LCU to the EOT unit.

* * * * *